US006319878B1

(12) United States Patent
Ina et al.

(10) Patent No.: US 6,319,878 B1
(45) Date of Patent: Nov. 20, 2001

(54) THERMOSENSITIVE RECORDING MEDIUM

(75) Inventors: Hiroyuki Ina; Ryohichi Kitajima; Isao Washio; Shinji Okada; Motoo Tasaka, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/174,062

(22) Filed: Oct. 16, 1998

(30) Foreign Application Priority Data

| | | |
|---|---|---|
| Oct. 17, 1997 | (JP) | 9-299587 |
| Oct. 31, 1997 | (JP) | 9-314647 |
| Nov. 10, 1997 | (JP) | 9-321971 |
| Jan. 22, 1998 | (JP) | 10-024050 |
| Jan. 29, 1998 | (JP) | 10-030398 |
| Oct. 16, 1998 | (JP) | 10-309541 |

(51) Int. Cl.[7] ..... B41M 5/40

(52) U.S. Cl. ..... 503/200; 503/216; 503/226

(58) Field of Search ..... 427/150–152; 503/200, 207, 226, 216

(56) References Cited

U.S. PATENT DOCUMENTS

| | | | | |
|---|---|---|---|---|
| 5,087,527 | | 2/1992 | Shimura et al. | 428/488.4 |
| 5,409,881 | | 4/1995 | Mori et al. | 503/207 |
| 5,536,697 | | 7/1996 | Hada et al. | 503/207 |
| 5,652,195 | * | 7/1997 | Horsten et al. | 503/226 |
| 5,866,507 | * | 2/1999 | Suzaki et al. | 503/207 |

* cited by examiner

*Primary Examiner*—Bruce H. Hess
(74) *Attorney, Agent, or Firm*—Cooper & Dunham LLP

(57) ABSTRACT

A thermosensitive recording medium capable of forming a visible image thereon when subjected to thermal printing, which has a transparent support, a thermosensitive recording layer provided on the transparent support, containing a dye and a color developer capable of inducing a color in the dye upon the application of heat thereto in the course of the thermal printing, and a mat layer, containing a granular thermosensitive recording layer, containing a granular filler and a binder resin, the mat layer having a surface smoothness of 100 to 2000 sec before subjected to the thermal printing, and a portion of the mat layer subjected to the thermal printing having a surface smoothness of 5,000 sec or less at most.

20 Claims, 1 Drawing Sheet

THERMOSENSITIVE RECORDING MEDIUM

BACKGROUND OF THE INVENTION

1. Field of the Invention

The present invention relates to a thermosensitive recording medium useful as a block copy film for flexography, gravure printing, offset printing and screen process printing.

2. Discussion of Background

A thermosensitive recording medium which comprises a transparent support and a thermosensitive recording layer formed thereon can produce an image therein when a dye and a color developer contained in the thermosensitive recording layer undergo the coloring reaction by the application of heat thereto. This type of thermosensitive recording medium is used by directly printing images thereon, for example, as an image formation film for overhead projectors and a second original for diazo copying. In addition to the above, this type of recording medium can also be used as a block copy film for flexography, gravure printing, offset printing and screen process printing when a predetermined image is thermally recorded in the thermosensitive recording medium.

When the above-mentioned image bearing thermosensitive recording medium is used as a block copy film for textile printing or flexographic printing, sufficient contrast between a colored portion and a background portion in the ultraviolet region is remarkably significant. If the contrast is insufficient, it is necessary to extend the ultraviolet exposure time when a form plate is prepared by exposing the image bearing thermosensitive recording medium to ultraviolet lamp, or at the worst, the image bearing thermosensitive recording medium may be useless as a block copy film.

For instance, when a transparent thermosensitive recording medium is used as a block copy film, a form plate for use in the flexographic printing can be obtained by following the procedures as shown below, with reference to FIG. 1:

(1) A photo-setting resin plate 1 is set on a glass sheet of an exposure apparatus.

(2) A transparent thermosensitive recording medium 2 which has been subjected to thermal printing in order to produce a predetermined colored image therein is closely attached to the photo-setting resin plate 1.

(3) A cover film 3 is overlaid on the image bearing thermosensitive recording medium 1.

(4) Air remaining under the cover film 3 is driven out in the direction of the arrow using a vacuum pump 4.

(5) Air bubbles remaining between the photo-setting resin plate 1 and the thermosensitive recording medium 2 are expelled therefrom, for example, by rolling a cylindrical jig over the cover film 3.

(6) The image bearing thermosensitive recording medium 2 is exposed to ultraviolet lamps 5 so as to set a portion of the photo-setting resin plate 1 corresponding to a background portion of the image bearing thermosensitive recording medium 2.

(7) A switch for the vacuum pump 4 is turned off and the cover film 3 is removed, and then the thermosensitive recording medium 2 is peeled from the photo-setting resin plate 1. The resin plate 1 is subjected to cleaning, thereby obtaining a form plate.

As shown in FIG. 2, if there remains an air bubble 6 between the thermosensitive recording medium 2 and the photo-setting resin plate 1, the thermosensitive recording medium 2 cannot come in contact with the photo-setting resin plate 1. The result is that the edge sharpness of a convex portion formed on the form plate is decreased, so that the quality of the obtained form plate is considerably impaired.

In particular, when the thermosensitive recording sheet is large size, for example, A0 size, it is very difficult to remove the air bubbles generating between the photo-setting resin plate and the thermosensitive recording sheet from the end of the thermosensitive recording sheet.

When the contact surface of the thermosensitive recording medium 2 with the photo-setting resin plate 1 is properly roughened, it is easy to remove the air bubbles generating between the recording medium 2 and the photo-setting resin plate 1 at the aforementioned ultraviolet exposure step. Therefore, it is proposed to employ a matte finished thermosensitive recording sheet.

However, when the surface roughness of the thermosensitive recording medium is increased to facilitate the removal of the above-mentioned air bubbles in the course of the making of a form plate, the thermosensitive recording medium cannot be brought into close contact with a thermal head in the course of thermal printing. As a result, thermal transmission becomes poor and uneven, so that the thermal sensitivity of the recording medium is lowered, and therefore, the coloring density of the obtained image is uneven and many non-printed spots are formed in a solid image area.

As mentioned above, the conventional thermosensitive recording medium has the problem that thermal printing cannot be uniformly performed because the surface of the recording medium is roughened in order to efficiently remove the air bubbles in the course of the making of a form plate. To solve the above-mentioned problem, the thermal energy supplied to the recording medium by the thermal head is increased. However, in such a case, the surface of the thermosensitive recording medium is made flat after the application of a large quantity of heat and pressure thereto, whereby the air bubbles are easily generated between the recording medium and the photo-setting resin plate in the course of the making of a form plate.

In Japanese Laid-Open Patent Application 9-86046 there is proposed a thermosensitive recording medium comprising a thermosensitive recording layer and a top layer provided thereon. The above-mentioned recording medium is designed for an image recording sheet by directly recording images therein, not for a block copy film for printing. In this application, the relationship between the thickness of the top layer and the average particle diameter of the filler particles for use in the top layer is specified in order to prevent the thermosensitive recording medium from sticking to the thermal head when thermal printing is carried out.

Furthermore, a thermosensitive recording medium disclosed in Japanese Laid-Open Patent Application 10-166737 is intended as a block copy film. However, the surface roughness and the dynamic friction coefficient of the top layer of the recording medium specified in this application are those obtained before the recording medium is subjected to thermal printing.

In the above-mentioned conventional thermosensitive recording media, the top surface layer is made flat after the completion of image formation by the application of thermal energy and pressure to the recording medium using a thermal head.

SUMMARY OF THE INVENTION

Accordingly, a first object of the present invention is to provide a thermosensitive recording medium which can be used as a block copy film for the preparation of a form plate for printing process in such a manner that a predetermined image is produced in the thermosensitive recording medium and the image bearing recording medium is attached to a photo-setting resin plate, with air bubbles remaining between the thermosensitive recording medium and the resin plate being easily removed therefrom in the course of the exposure step for making a form plate.

A second object of the present invention is to provide a thermosensitive recording medium with high thermal sensitivity, capable of recording clear images therein.

A third object of the present invention is to provide a thermosensitive recording medium capable of producing an image therein free of non-printed spots in a solid image area.

The above-mentioned objects of the present invention can be achieved by a thermosensitive recording medium capable of forming a visible image thereon when subjected to thermal printing, which comprises a transparent support, a thermosensitive recording layer provided on the transparent support, comprising a dye and a color developer capable of inducing a color in the dye upon the application of heat thereto in the course of the thermal printing, and a mat layer provided on the thermosensitive recording layer, comprising a granular filler and a binder resin, the mat layer having a surface smoothness of 100 to 2000 sec before subjected to the thermal printing, and a portion of the mat layer subjected to the thermal printing having a surface smoothness of 5,000 sec or less at most.

With respect to the mat layer, it is preferable that the granular filler be partly protruded from the surface of the mat layer in a number of 1,000 to 5,000/mm$^2$.

It is preferable that the granular filler have an average particle diameter which is greater than an average thickness of the mat layer.

In addition, the granular filler may comprise an organic filler. In this case, it is preferable that the organic filler comprise spherical organic cross-linked filler particles with an average particle diameter of 3 to 10 $\mu$m.

Further, it is preferable that the granular filler in the mat layer be in an amount of 5 to 10 wt. % of the entire weight of the mat layer, and that the granular filler comprise giant filler particles with a particle diameter of $\{(d\mathbf{1}+d\mathbf{2})\times 1.2\}$ micrometer ($\mu$m) or more in an amount of less than 0.1 wt. % of the total weight of the granular filler, where the thermosensitive recording layer has a thickness of d1 micrometer ($\mu$m), and the mat layer has a thickness of d2 micrometer ($\mu$m).

Furthermore, it is desirable that the binder resin in the mat layer comprise an ultraviolet curing resin and/or an electron-beam curing resin in an amount of 50 wt. % of the entire weight of the binder resin.

The thermosensitive recording medium may further comprise an intermediate layer interposed between the thermosensitive recording layer and the mat layer, comprising at least an ultraviolet curing resin or an electron-beam curing resin.

It is preferable that the color developer for use in the thermosensitive recording layer comprise an organic phosphoric acid compound of formula (1) or formula (2):

(1)

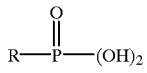

wherein R is a straight-chain alkyl group having 16 to 24 carbon atoms.

(2)

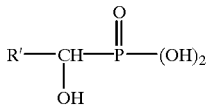

wherein R' is a straight-chain alkyl group having 13 to 23 carbon atoms.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
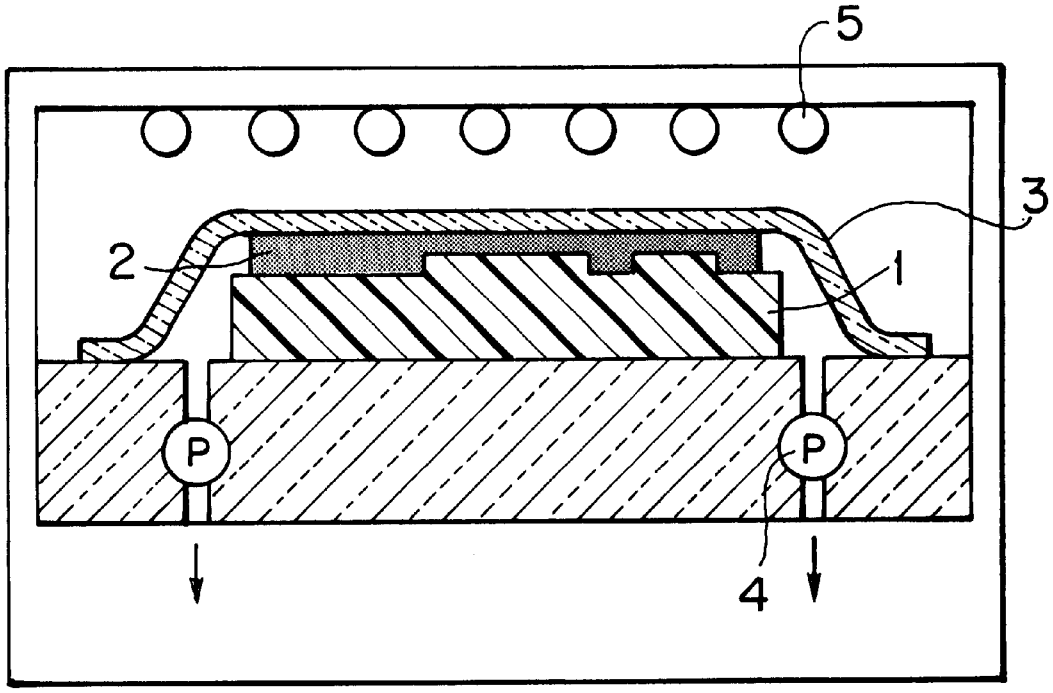
FIG. 1 is a schematic cross-sectional view in explanation of the procedures for preparation of a form plate for the flexographic printing process using an image bearing thermosensitive recording medium as a block copy film.
Figure 2:
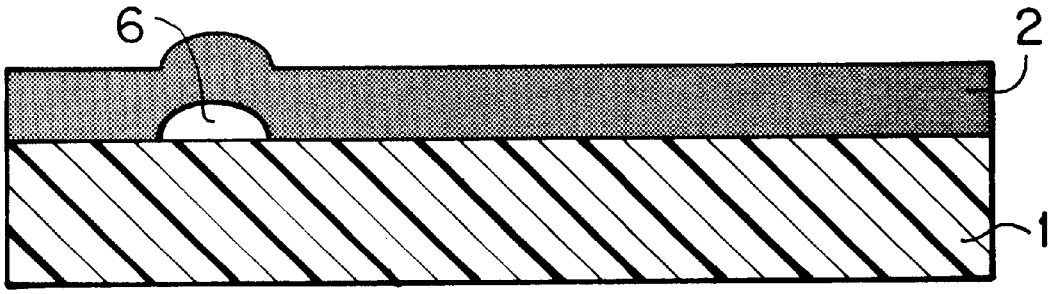
FIG. 2 is a schematic cross-sectional view in explanation of the problem of a conventional thermosensitive recording medium caused by an air bubble remaining between the thermosensitive recording medium and a photo-setting resin plate in the course of the making of a form plate.

According to the present invention, a thermosensitive recording medium comprises a transparent support, a thermosensitive recording layer which is formed on the support and comprises a dye and a color developer, and a mat layer which is formed on the thermosensitive recording layer and comprises a granular filler and a binder resin. The surface smoothness of the mat layer is adjusted to 100 to 2000 sec, preferably 200 to 1000 sec before subjected to thermal printing. In addition, when an image is thermally recorded in the thermosensitive recording medium, the surface smoothness of the image portion formed in the recording medium is also controlled to at most 5,000 sec or less at most. Therefore, clear images can be obtained in the recording medium because of high thermal sensitivity, thereby obtaining a high quality block copy film. At the same time, when the image bearing thermosensitive recording medium serving as a block copy film is attached to a photo-setting resin plate and exposed to light to prepare a form plate for the printing process, air bubbles generating at the gap between the recording medium and the resin plate can be easily removed therefrom, thereby obtaining a satisfactory form plate for the printing process.

In the present invention, the surface smoothness of the thermosensitive recording medium is measured in accordance with JAPAN TAPPI No. 5-74, "Testing Method for Smoothness and Air Permeability of Paper and Paper board by Air Micrometer".

When a form plate is prepared using the image-bearing thermosensitive recording medium, the quality of the obtained form plate depends upon the size and the number of air bubbles remaining between the thermosensitive recording medium and the photo-setting resin plate in the course of the ultraviolet exposure step.

For instance, an air bubble with a diameter of 20 mm has no decisive effect on the quality of the obtained form plate when the number of air bubbles is not so much. However, the quality of the form plate is impaired when there are a large number of such air bubbles. A large air bubble with a diameter of about 100 mm has a serious effect on the quality of the obtained form plate even though the number of air bubbles is 2 or 3.

It is preferable that the filler particles be partly protruded from the surface of the mat layer in a number of 1,000 to 5,000/mm$^2$. In this case, removal of the air bubbles from the gap between the thermosensitive recording medium and the photo-setting resin plate becomes very easy.

The above specified surface smoothness of the thermosensitive recording medium before or after thermal printing can be adjusted by controlling the particle diameter and the amount of the filler particles contained in the mat layer.

It is preferable that the average particle diameter of the granular filler for use in the mat layer be larger than the average thickness of the mat layer. To be more specific, it is desirable to employ an organic filler comprising spherical organic cross-linked filler particles with an average particle diameter of 3 to 10 $\mu$m. In this case, clear images can be formed in the thermosensitive recording medium without the decrease of thermal sensitivity, and the durability of the mat layer can be improved.

From the viewpoint of heat resistance, it is preferable that the amount ratio by weight of the granular filler for use in the mat layer be in a range of 5 to 10 wt. % of the entire weight of the mat layer.

When the granular filler for use in the mat layer include giant particles, for example, particles with a diameter about 10 times larger than the average particle of the filler, the thermal sensitivity is lowered, and therefore, non-printed spots are easily formed in a solid image area.

When the thermosensitive recording layer has a thickness of d1 micrometer and the mat layer has a thickness of d2 micrometer, it is preferable that the content of the giant filler particles with a particle diameter of $\{(d\mathbf{1}+d\mathbf{2})\times 1.2\}$ or more be less than 0.1 wt. % of the total weight of the granular filler.

Before the mat layer is coated on the thermosensitive recording layer, the particle size and the particle size distribution of the granular filler for use in the mat layer can be measured by the laser analyzer method, Coulter counter method, particle analyzer method, or the observation with a scanning electron microscope. After the mat layer is provided on the recording layer, the particle size and the particle size distribution of the granular filler contained in the mat layer is measured by observing the surface portion with a scanning electron microscope.

The particle size and the particle size distribution of the granular filler may be controlled in the course of the preparation of the filler to be employed, or controlled by classification after the preparation thereof.

Inorganic or organic pigments can be employed as the filler for use in the mat layer. Specific examples of the filler for use in the mat layer are finely-divided particles of an inorganic pigment such as calcium carbonate, silica, zinc oxide, titanium oxide, aluminum hydroxide, zinc hydroxide, barium sulfate, clay, talc, and surface-treated calcium carbonate and silica; and finely-divided particles of an organic pigment such as urea-formalin resin, styrene-methacrylic acid copolymer, polystyrene resin and silicone resin.

The mat layer for use in the thermosensitive recording medium of the present invention serves to control the surface smoothness of the recording medium. In addition to the above, the transparency, chemical resistance, water resistance, friction resistance and light resistance of the recording medium and the matching properties with the thermal head can be improved by the provision of the mat layer.

The mat layer comprises the binder resin. As the binder resin for use in the mat layer, there can be employed a water-soluble resin, an aqueous emulsion hydrophobic resin, and an ultraviolet curing resin or an electron-beam curing resin.

Specific examples of the water-soluble resins for use in the mat layer are polyvinyl alcohol, modified polyvinyl alcohol, cellulose derivatives such as methyl cellulose, methoxy cellulose, and hydroxy cellulose, casein, gelatin, polyvinyl pyrrolidone, styrene-maleic anhydride copolymer, diisobutylene-maleic anhydride copolymer, polyacrylamide, modified polyacrylamide, methyl vinyl ether-maleic anhydride copolymer, carboxyl-modified polyethylene, polyvinyl alcohol-acrylamide block copolymer, melamine-formaldehyde resin, and urea-formaldehyde resin.

Specific examples of aqueous emulsion resins or hydrophobic resins for use in the mat layer are polyvinyl acetate, polyurethane, styrene-butadiene copolymer, styrene-butadiene-acrylic copolymer, polyacrylic acid, polyacrylic ester, vinyl chloride-vinyl acetate copolymer, polybutyl methacrylate, polyvinyl butyral, polyvinyl acetal, ethyl cellulose, and ethylene-vinyl acetate copolymer. Further, a copolymer comprising the segments constituting the above-mentioned resins and a silicone segment can be preferably employed. These resins can be used alone or in combination. When necessary, a curing agent may be added to these resins to cure the resins.

In particular, when the binder resin for use in the mat layer comprises a ultraviolet curing resin or an electron-beam curing resin in an amount of 50 wt. % of the total weight of the binder resin, the film strength of the obtained mat layer can be improved.

For the ultraviolet-curing resin, there can be employed any conventional monomer, oligomer, or prepolymer that is polymerizable to form a cured resin by the application thereto of ultraviolet light. There are no limitations on such a monomer, oligomer or prepolymer for the preparation of the ultraviolet-curing resin for use in the mat layer.

Preferable examples of the electron-beam curing resin for use in the mat layer include an electron-beam curing resin comprising a polyester skeleton with a five or more functional branched molecular structure, and a silicone-modified electron-beam curing resin.

The mat layer for use in the thermosensitive recording medium may further comprise a light stabilizer for improvement of the light resistance, and a lubricant additive for improvement of the lubricity.

Examples of the light stabilizer for use in the present invention include an ultraviolet absorbing agent, an antioxidant, an anti-aging agent, a singlet oxygen extinction agent and a superoxide anion extinction agent.

Examples of the lubricant additive include a silicone oil, a surfactant, an organic salt, and a wax.

Specific examples of the silicone oil for use in the mat layer include dimethyl polysiloxane, methylphenyl polysiloxane, methylhydrodiene polysiloxane, alkyl-modified polysiloxane, amino-modified polysiloxane, carboxyl-modified polysiloxane, and alcohol-modified polysiloxane.

Examples of the surfactant include carboxylate, sulfuric acid ester salts of higher alcohols, sulfonic acid salts, and phosphoric acid esters of higher alcohols and salts thereof.

Specific examples of the above compounds include sodium laurate, sodium stearate, sodium oleate, sodium sulfuric acid ester of lauryl alcohol, sodium sulfuric acid ester of myristyl alcohol, sodium sulfuric acid ester of cetyl alcohol, sodium sulfuric acid ester of stearyl alcohol, sodium sulfuric acid ester of oleyl alcohol, sodium sulfuric acid ester of an ethylene oxide adduct of higher alcohol, sodium octyl sulfonate, sodium decyl sulfonate, sodium dodecyl sulfonate, sodium octyl benzenesulfonate, sodium dodecyl benzenesulfonate, potassium dodecyl benzenesulfonate, sodium nonyl naphthalenesulfonate, sodium dodecylnaphthalenesulfonate, potassium dodecyl naphthalenesulfonate, sodium salt of N-oleoyl-N-methyltaurine, esters of tetraethoxylauryl alcohol, sodium monostearyl phosphate, and sodium distearyl phosphate.

Specific examples of the organic salt include metallic soap such as zinc stearate, aluminum stearate, calcium stearate and magnesium stearate; and salts such as hexyl ammonium chloride, sodium sulfosalicylate, sodium succinate, potassium succinate, potassium benzoate, and potassium adipate.

Specific examples of the wax are natural waxes such as candelilla wax, carnauba wax, rice wax, bees wax, hydrous lanolin wax, montan wax, paraffin wax, and microcrystalline wax; and synthetic waxes such as polyethylene wax, hardened castor oil or hardened castor oil derivatives, and fatty acid amides.

It is proper that the amount of the lubricant additive be in the range of 0.001 to 15.0 wt. % of the total weight of the mat layer. When the amount ratio of the lubricant additive is within the above-mentioned range, sufficient lubricating properties can be obtained without the deterioration of the mechanical strength of the mat layer.

The mat layer can be provided on the thermosensitive recording layer by the conventional coating method.

It is preferable that the deposition amount of a coating liquid for the mat layer be in a range of 0.2 to 20 g/m$^2$, more preferably in a range of 0.5 to 10 g/m$^2$ on a dry basis. The thickness of the mat layer is preferably in a range of 1 to 8 $\mu$m, more preferably in a range of 2 to 4 $\mu$m.

When the application amount or the thickness of the mat layer is within the above-mentioned range, the mat layer can sufficiently work as a protective layer in terms of the storage stability of the recording medium and the head-matching properties with the thermal head. In addition, there is no problem from the viewpoint of thermal sensitivity of the recording medium or the manufacturing cost.

The thermosensitive recording medium of the present invention may further comprise an intermediate layer which is interposed between the thermosensitive recording layer and the mat layer. In this case, it is preferable that the intermediate layer comprise an ultraviolet curing resin or an electron-beam curing resin because making of dents in the thermosensitive recording layer can be inhibited even when heat and pressure are applied to the recording medium by the thermal head.

For the preparation of the ultraviolet-curing resin for use in the intermediate layer, there can be employed any conventional monomer, oligomer, or prepolymer that is polymerizable to form a cured resin by the application thereto of ultraviolet light. There are no limitations on such a monomer, oligomer or prepolymer.

The kind of electron-beam curing resin for use in the intermediate layer is not particularly limited. An electron-beam curing resin comprising a polyester skeleton with a five or more functional branched molecular structure, and a silicone-modified electron-beam curing resin are preferably employed for the intermediate layer.

The same filler as used in the mat layer may be contained in the intermediate layer to improve the mechanical strength thereof.

The thermosensitive recording layer comprises a color developer and a dye.

The color developer for use in the thermosensitive recording layer is an electron-accepting compound capable of inducing color formation in the above-mentioned dye. A variety of conventional electron-accepting color developers can be employed in the present invention. In particular, an electron-accepting color developer having a long-chain alkyl group in its molecule as stated in Japanese Patent Application 3-355078 is preferable used as the color developer in the present invention.

For example, there can be employed as the color developers an organic phosphoric acid compound, an aliphatic carboxylic acid compound and a phenolic compound, each having an aliphatic group with 12 or more carbon atoms; a metallic salt of mercaptoacetic acid having an aliphatic group with 10 to 18 carbon atoms; an alkylester of caffeic acid having an alkyl group with 5 to 8 carbon atoms; and an acid phosphate having an aliphatic group with 16 or more carbon atoms. The above-mentioned aliphatic group includes a straight-chain or branched alkyl group or alkenyl group, which may have a substituent such as a halogen atom, an alkoxyl group, or an ester group.

In the present invention, the following organic phosphoric acid compounds represented by formulas (1) and (2) are preferably employed as the color developers:

(1)

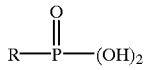

wherein R is a straight-chain alkyl group having 16 to 24 carbon atoms.

(2)

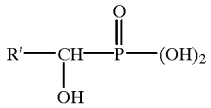

wherein R' is a straight-chain alkyl group having 13 to 23 carbon atoms.

With respect to the amount ratio of the color developer to the coloring agent, it is preferable that one to 20 parts by weight, more preferably 2 to 10 parts by weight, of the color developer be used in combination with one part by weight of the coloring agent.

The aforementioned color developers may be used alone or in combination.

The thermosensitive recording layer comprises an electron-donating compound as a coloring agent. The coloring agent for use in the present invention is a colorless or light-colored dye precursor and is not limited to particular compounds, but conventional coloring agents such as triphenylmethane phthalide leuco compounds, triallylmethane leuco compounds, fluoran leuco compounds, phenothiazine leuco compounds, thiofluoran leuco compounds, xanthene leuco compounds, indolinophthalide leuco compounds, spiropyran leuco compounds, azaphtalide leuco compounds, couromenopyrazole leuco compounds, methine leuco compounds, rhodaminenilinolactam leuco compounds, rhodaminelactam leuco compounds, quinazoline leuco compounds, diazaxanthene leuco compounds, and bislactone leuco compounds are preferably employed.

Specific examples of those leuco dyes are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-methyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(m-trifluoromethylanilino)-6-diethylaminofluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-methyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-n-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylamino-fluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino)-fluoran,
2-dibenzylamino-4-methyl-6-diethylaminofluoran,
2-dibenzylamino-4-methoxy-6-(N-methyl-p-toluidino)-fluoran,
2-dibenzylamino-4-methyl-6-(N-ethyl-p-toluidino)-fluoran,
2-(α-phenylethylamino)-4-methyl-6-diethylaminofluoran
2-(p-toluidino)-3-(t-butyl)-6-(N-methyl-p-toluidino)-fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)-fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfuryl-amino) fluoran,
2-mesidino-4',5'-benzo-6-diethylaminofluoran,
2-(m-trifluoromethylanilino)-3-methyl-6-pyrrolidino-fluoran,
2-(α-naphthylamino)-3,4-benzo-4-bromo-6-(N-benzyl-N-cyclohexylamino) fluoran,
2-piperidino-6-diethylaminofluoran,
2-(N-n-propyl-p-trifluoromethylanilino)-6-morpholino-fluoran, 2-(di-N-p-chlorophenyl-methylamino)-6-pyrrolidino-fluoran,
2-(N-n-propyl-m-trifluoromethylanilino)-6-morpholino-fluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzo leuco methylene blue,
2-[3,6-bis(diethylamino)]-6-(o-chloroanilino)xanthyl-benzoic acid lactam,
2-[3,6-bis(diethylamino)]-9-(o-chloroanilino)xanthyl-benzoic acid lactam,
3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl) phthalide,
3-(2-hydroxy-4-dimethylaminophenyl)-3-(2-methoxy-5-chlorophenyl) phthalide,
3-(2-hydroxy-4-dimethylaminophenyl)-3-(2-methoxy-5-chlorophenyl)phthalide,
3-(2-hydroxy-4-dimethylaminophenyl)-3-(2-methoxy-5-nitrophenyl) phthalide,
3-(2-hydroxy-4-diethylaminophenyl(-3-(2-methoxy-5-methylphenyl) phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

The thermosensitive recording layer may further comprises a binder resin. Any conventional resins, in particular, resins having hydroxyl group or carboxyl group in the molecule thereof are preferably employed. Examples of such binder resins for use in the thermosensitive recording layer are polyvinyl acetal resins such a polyvinyl butyral and polyvinyl acetoacetal; cellulose derivatives such as ethyl cellulose, cellulose acetate, cellulose acetate propionate and cellulose acetate butyrate; and epoxy resin. Those resins can be used alone or in combination.

To obtain the thermosensitive recording layer, a coating liquid for the thermosensitive recording layer is prepared by uniformly dispersing or dissolving a coloring agent, a color developer and a binder resin in an organic solvent. Then, the coating liquid thus prepared is coated on a transparent support and dried. The coating method is not particularly limited.

It is preferable that the particle size of the particles dispersed in the coating liquid for the thermosensitive recording layer be 10 $\mu$m or less, more preferably 5 $\mu$m or less, and further preferably 1 $\mu$m or less.

The thickness of the thus obtained thermosensitive recording layer, which varies depending on the formulation for the thermosensitive recording layer or the application on the obtained thermosensitive recording medium, is preferably in the range of about 1 to 50 $\mu$m, more preferably in the range of 3 to 20 $\mu$m.

For the purpose of improving the coating properties and the recording characteristics, the coating liquid for the thermosensitive recording layer may further comprise a variety of additives which are employed in the conventional thermosensitive recording papers.

Some additives conventionally employed in this kind of thermosensitive recording medium, for example, a filler, a surfactant, a lubricant and an agent inhibiting the coloring reaction due to pressure application may be optionally added to the formulation for the recording layer so long as the transparency of the obtained recording medium is not impaired.

Specific examples of the filler for use in the thermosensitive recording layer are finely-divided particles of an inorganic filler such as calcium carbonate, silica, zinc oxide, titanium oxide, aluminum hydroxide, zinc hydroxide, barium sulfate, clay, kaolin, talc, and surface-treated calcium carbonate and silica; and finely-divided particles of an organic filler such as urea-formalin resin, styrene-methacrylic acid copolymer, polystyrene resin and vinylidene chloride resin.

Specific examples of the lubricant for use in the thermosensitive recording layer are higher fatty acids and metallic salts thereof, higher fatty acid amides, higher fatty acid esters, and waxes such as animal wax, vegetable wax, mineral wax and petroleum wax.

The thermosensitive recording medium of the present invention may further comprise an antistatic layer which is provided on the back side of the support, opposite to the thermosensitive recording layer with respect to the support.

The antistatic layer may comprise a surfactant or an electroconductive metallic oxide.

For the formation of the antistatic layer comprising a surfactant, anionic, cationic nonionic and amphoteric surfactants can be employed. In particular, cationic or amphoteric surfactants are superior from the viewpoints of antistatic properties and durability. Such an antistatic layer of a surfactant type can be prepared at relatively low cost, and many kinds of surfactants are usable. However, the surfactant type antistatic layer is susceptible to humidity because this kind of antistatic layer becomes electroconductive due to adsorption of moisture content by the surfactant. Therefore, the antistatic properties of the antistatic layer tend to lower under the circumstances of low humidity.

On the other hand, the antistatic layer comprising an electroconductive metallic oxide is expensive and does not have so many varieties. However, since the metallic oxide itself has electroconductivity, the antistatic layer of an electroconductive metallic oxide type exhibits sufficient electroconductivity even with a small deposition amount, so that high transparency of the thermosensitive recording medium can be maintained. In addition, the antistatic properties are excellent under the circumstances of low humidity.

Examples of the electroconductive metallic oxide for use in the antistatic layer include metallic oxides such as $SnO_2$, $IN_2O_3$, ZnO, $TiO_2$, MgO, $Al_2O_3$, BaO and $MoO_3$; and composite metallic oxides composed of the above-mentioned metallic oxides and metallic oxides of P, Sb, Sn and Zn.

The particles of the above-mentioned metallic oxide may be as fine as possible. The more fine particles of metallic oxide, the higher the transparency of the obtained recording medium. To be more specific, when the average particle diameter of the antistatic agent such as the metallic oxide is 0.2 $\mu$m or less, sufficient transparency can be obtained.

In the antistatic layer, the above-mentioned finely-divided particles of metallic oxide are used in combination with a binder agent such as a water-soluble resin, an aqueous emulsion, a hydrophobic resin, an ultraviolet-curing resin or an electron-beam curing resin.

Specific examples of the water-soluble resin for use in the antistatic layer include polyvinyl alcohol, cellulose derivative, casein, gelatin, styrene-maleic anhydride copolymer, and carboxy—modified polyethylene resin.

Specific examples of the resin for aqueous emulsion or the hydrophobic resin for use in the antistatic layer include polyvinyl acetate, polyurethane, vinyl chloride—vinyl acetate copolymer, polyester, polybutyl acrylate, polyvinyl butyral, polyvinyl acetal, and ethylene—vinyl acetate copolymer. These resins can be used alone or in combination. When necessary, a curing agent may be added to these resins to cure the resins.

The ultraviolet-curing resin for use in the antistatic layer is prepared by polymerizing a monomer, oligomer or prepolymer which is polymerizable to form a cured resin by the application of ultraviolet light thereto. There are no limitations on such a monomer, oligomer or prepolymer for the preparation of the ultraviolet-curing resin, and conventional monomers, oligomers and prepolymers can be employed.

There are no particular limitations on the electron-beam curing resins for use in the antistatic layer. A particularly preferably electron-beam curing resin for use in the antistatic layer is an electron-beam curing resin comprising a polyester skeleton with a five or more functional branched molecular structure.

In the antistatic layer of metallic oxide type, it is preferable that the amount of metallic oxide be in the range of about 0.05 to 2 parts by weight, and more preferably in the range of about 0.2 to 1.5 parts by weight, to one part by weight of the binder resin.

With respect to the transparent support for use in the thermosensitive recording medium according to the present invention, it is preferable to employ a support material with a refractive index of 1.45 to 1.60 at room temperature. For instance, there can be employed a film made of a polyester resin such as polyethylene terephthalate or polybutylene terephthalate; a film made of a cellulose derivative such as cellulose triacetate; a film made of a polyolefin resin such as polypropylene or polyethylene; and a film of polystyrene. Further, those films may be laminated to prepare a transparent support of the thermosensitive recording medium.

The thermosensitive recording medium of the present invention may further comprise an adhesive layer which is interposed between the support and the thermosensitive recording layer. Examples of the material for the adhesive layer include acrylic resin, saturated polyester resin, and polyamide resin. Those resins may be cured.

A colored image can be formed in the thermosensitive recording medium of the present invention by the application of heat thereto using a thermal head, thermal pen or laser beam.

Other features of this invention will become apparent in the course of the following description of exemplary embodiments, which are given for illustration of the invention and are not intended to be limiting thereof.

EXAMPLE 1

(Formation of Thermosensitive Recording Layer)

A mixture of the following components was sufficiently dispersed and pulverized in a ball mill so as to have a particle size of about 0.3 μm, whereby a coating liquid A for a thermosensitive recording layer was prepared:

[Coating liquid A for thermosensitive recording layer]

| | Parts by Weight |
|---|---|
| 2-methyl-3-ethylamino-7-(o-chlorophenyl)aminofluoran | 3 |
| Octadecylphosphonic acid | 9 |
| Polyvinyl butyral "Denka Butyral #3000-2" (Trademark) made by Denki Kagaku Kogyo Kabushiki kaisha | 4.5 |
| Toluene | 41.5 |
| Methyl ethyl ketone | 42 |

The thus prepared thermosensitive recording layer coating liquid A was coated on a 100-μm-thick polyester film serving as a support, and dried, whereby a thermosensitive recording layer with a thickness of 14 μm was formed on the support.

(Formation of Mat Layer)

The following components were mixed to prepare a coating liquid B for a mat layer:

[Coating liquid B for mat layer]

| | Parts by Weight |
|---|---|
| Ultraviolet curing resin "V-9057" (Trademark), made by Dainippon ink & Chemicals, Incorporated (solid content: 75%) | 50 |
| Cured acrylic particles "MX-700" (Trademark), made by Soken Chemical Co., Ltd. (average particle diameter: 7.0 μm) | 4 |
| Methyl ethyl ketone | 54 |

The thus obtained mat layer coating liquid B was coated on the above-prepared thermosensitive recording layer using a wire bar, and dried, whereby a mat layer was provided on the thermosensitive recording layer so that the deposition amount of the mat layer coating liquid was 3.5 g/m$^2$on a dry basis.

Thus, a thermosensitive recording medium No. 1 according to the present invention was obtained.

EXAMPLE 2

The procedure for preparation of the thermosensitive recording medium No. 1 in Example 1 was repeated except that the coating liquid B for the mat layer used in Example 1 was changed to the following coating liquid C for a mat layer:

[Coating liquid C for mat layer]

| | Parts by Weight |
|---|---|
| Ultraviolet curing resin "V-9057" (Trademark), made by Dainippon ink & Chemicals, Incorporated (solid content: 75%) | 50 |
| Cured acrylic particles "MX-700" (Trademark), made by Soken Chemical Co., Ltd. (average particle diameter: 7.0 μm) | 8 |
| Ethyl acetate | 25 |

Thus, a thermosensitive recording medium No. 2 according to the present invention was obtained.

EXAMPLE 3

The procedure for preparation of the thermosensitive recording medium No. 1 in Example 1 was repeated except that the coating liquid B for the mat layer used in Example 1 was changed to the following coating liquid D for a mat layer:

[Coating liquid D for mat layer]

| | Parts by Weight |
|---|---|
| Ultraviolet curing resin "V-9057" (Trademark), made by Dainippon ink & Chemicals, Incorporated (solid content: 75%) | 50 |
| Cured acrylic particles "MX-500" (Trademark), made by Soken Chemical Co., Ltd. (average particle diameter: 5.0 μm) | 3 |
| Ethyl acetate | 25 |

Thus, a thermosensitive recording medium No. 3 according to the present invention was obtained.

EXAMPLE 4

(Formation of Thermosensitive Recording Layer)

A mixture of the following components was sufficiently dispersed and pulverized in a ball mill so as to have a particular size of about 0.3 μm, whereby a coating liquid A for a thermosensitive recording layer was prepared:

[Coating liquid A for thermosensitive recording layer]

| | Parts by Weight |
|---|---|
| 2-methyl-3-ethylamino-7-(o-chlorophenyl)aminofluoran | 3 |
| Octadecylphosphonic acid | 9 |
| Polyvinyl butyral "Denka Butyral #3000-2" (Trademark) made by Denki Kagaku Kogyo Kabushiki kaisha | 4.5 |
| Toluene | 41.5 |
| Methyl ethyl ketone | 42 |

The thus prepared thermosensitive recording layer coating liquid A was coated on a 100-μm-thick polyester film serving as a support, and dried, whereby a thermosensitive recording layer with a thickness of 14 μm was formed on the support.

(Formation of Intermediate Layer)

The following components were mixed to prepare a coating liquid E for an intermediate layer:

[Coating liquid E for intermediate layer]

| | Parts by Weight |
|---|---|
| Ultraviolet curing resin "V-9057" (Trademark), made by Dainippon ink & Chemicals, Incorporated (solid content: 75%) | 64 |
| Ethyl acetate | 31 |
| Silicone oil "BYK-344" (Trademark), made by Byk-Chemie Japan K.K. (solid content: 52%) | 5 |

The thus obtained intermediate layer coating liquid E was coated on the above-prepared thermosensitive recording layer using a wire bar, and dried, and then cured by the application of ultraviolet lamp of 80 W/cm, whereby an intermediate layer with a thickness of 1.5 μm was provided on the thermosensitive recording layer.

(Formation of Mat Layer)

The following components were mixed to prepare a coating liquid F for a mat layer:

[Coating liquid F for mat layer]

| | Parts by Weight |
|---|---|
| Silicone-modified butyral resin "SP-712" (Trademark), made by DainichiSeika Color and Chemicals, Mfg. Co., Ltd. (solid content: 12.5%) | 46 |
| Silicone particles "Tospearl 145" (Trademark), made by Toshiba Silicone Co., Ltd. (average particle diameter: 4.5 μm) | 2 |
| Methyl ethyl ketone | 54 |

The thus obtained mat layer coating liquid F was coated on the above-prepared intermediate layer using a wire bar, and dried, whereby a mat layer was provided on the intermediate layer so that the deposition amount of the mat layer coating liquid was 3.5 g/m$^2$ on a dry basis.

Thus, a thermosensitive recording medium No. 4 according to the present invention was obtained.

COMPARATIVE EXAMPLE 1

The procedure for preparation of the thermosensitive recording medium No. 1 in Example 1 was repeated except that the cured acrylic particles for use in the formulation of the mat layer coating liquid B in Example 1 were removed therefrom.

Thus, a comparative thermosensitive recording medium No. 1 was obtained.

COMPARATIVE EXAMPLE 2

The procedure for preparation of the thermosensitive recording medium No. 2 in Example 2 was repeated except that the cured acrylic particles with an average particle diameter of 7.0 μm for use in the formulation for the mat layer coating liquid C in Example 2 were replaced by silicone particles with an average particle diameter of 12.0 μm.

Thus, a comparative thermosensitive recording medium No. 2 was obtained.

COMPARATIVE EXAMPLE 3

The procedure for preparation of the thermosensitive recording medium No. 2 in Example 2 was repeated except that the amount of cured acrylic particles for use in the formulation for the mat layer coating liquid C in Example 2 was changed from 8 to 2 parts by weight.

Thus, a comparative thermosensitive recording medium No. 3 was obtained.

With respect to each of the above prepared thermosensitive recording media, the following measurement was carried out.

[Surface smoothness of mat layer]

The surface smoothness of the mat layer before subjected to thermal printing and the surface smoothness of a portion of the mat layer subjected to the thermal printing were measured using a commercially available surface smoothness tester "OKEN TYPE SMOOTHNESS TESTER" (Trademark), made by Kumagai Riki Kogyo Co., Ltd.

[Number of granular filler partly protruded from the surface of mat layer]

By observing the surface of the mat layer with a scanning type electron microscope, the number of granular filler partly protruded from the surface was obtained.

[Content of giant filler particles in mat layer]

The content of giant filler particles contained in each mat layer coating liquid was obtained using a commercially available particle size analyzer "La-700" (Trademark), made by HORIBA, Ltd.

The thickness (d1) of the thermosensitive recording layer, the thickness (d2) of the mat layer, the average particle size of the filler, and the content of the giant filler particles in the mat layer are shown in Table 1.

TABLE 1

| | Surface Smoothness of Mat Layer (sec) | | | | | | |
|---|---|---|---|---|---|---|---|
| | Colored portion (after thermal printing) | Background portion (before thermal printing) | Number of Granular Filler in Surface Portion (/mm$^2$) | Average Particle Diameter of Filler Particles (μm) | Average Thickness (μm) Recording Layer | Average Thickness (μm) Mat Layer | Content of Giant Filler Particles (wt. %) |
| Ex.1 | 1300 | 230 | 1572 | 7.0 | 13 | 2.0 | 0 |
| Ex.2 | 950 | 210 | 2850 | 7.0 | 13 | 3.0 | 0.5 |
| Ex.3 | 4500 | 1000 | 3290 | 5.0 | 13 | 3.5 | 0 |
| Ex.4 | 4200 | 1000 | 4886 | 4.5 | 13 | 2.5 | 0.5 |
| Comp. Ex.1 | 30000 | 10000 | 0 | — | 13 | 2.5 | 0 |
| Comp. Ex. 2 | 730 | 50 | 600 | 12.0 | 13 | 3.0 | 2.0 |
| Comp. Ex. 3 | 5500 | 210 | 780 | 7.0 | 13 | 3.0 | 0 |

Each of the transparent thermosensitive recording media No. 1 to No. 4 according to the present invention and comparative transparent thermosensitive recording media No. 1 to No. 3 was subjected to the following evaluation tests:

(1) Thermal sensitivity

Using a thermal printing simulator made by Okura Denki Co., Ltd., each transparent thermosensitive recording medium was subjected to thermal printing to produce a colored image therein at 25° C. and 50% RH, with the thermal energy applied to the recording medium being changed. The applied thermal energy by which the coloring density of the colored image portion was saturated was regarded as the thermal sensitivity.

(2) Coloring density of image portion

Using a thermal printing simulator made by Okura Denki Co., Ltd., each transparent thermosensitive recording medium was subjected to thermal printing to produce a colored image therein at 25° C. and 50% RH with the application of a thermal energy of 30 mJ/mm$^2$ to the recording medium under the following conditions:

Dot density of a thermal head:8 dots/mm

Platen pressure:6 kg/A4 size

Applied electric power:0.68 W/dot

Pulse width:0.7 msec

Line period:10 msec/line

The coloring density of the image portion produced in the recording medium by the application of heat thereto was measured using a transmission type densitometer "X-Rite 309" (Trademark), made by XRITE Company, Ltd., at the UV position.

(3) Removal of air from a block copy film and a photo-setting resin plate

Images were thermally printed in each transparent thermosensitive recording medium using a commercially available thermal plotter "TP4910" (Trademark), made by Ricoh Company, Ltd., so that a block copy film for the preparation of a form plate was obtained. The image-area occupation ratio in the block copy film was 50%.

The thus obtained block copy film was brought into contact with a commercially available photo-setting resin plate (made by Du Pont de Nemours, E. I. & Co.) in such a configuration that the mat layer was in contact with the photo-setting resin plate, and set in an exposure apparatus for the preparation of the form plate. After the ultraviolet exposure was carried out for 400 seconds, it was visually checked whether air bubbles had been removed from the gap between the block copy film and the photo-setting resin plate, or not.

(4) Non-printed spots

A solid image area was thermally printed in each transparent thermosensitive recording medium using a commercially available thermal plotter "TP4910" (Trademark), made by Ricoh Company, Ltd. The presence on non-printed spots in the solid image area was visually observed.

The results of the above-mentioned evaluations are shown in Table 2.

TABLE 2

| | Thermal Sensitivity (mJ/mm$^2$) | Coloring Density | Remaining Air Bubbles | Non-printed Spots in Solid Image Area |
|---|---|---|---|---|
| Ex. 1 | 30.6 | 3.58 | No | No |
| Ex. 2 | 31.0 | 3.55 | No | No |
| Ex. 3 | 28.5 | 3.56 | No | No |
| Ex. 4 | 28.2 | 3.49 | No | No |
| Comp. Ex. 1 | 26.1 | 3.54 | Yes | No |
| Comp. Ex. 2 | 32.1 | 2.33 | No | Many non-printed spots were observed |
| Comp. Ex. 3 | 31.0 | 3.56 | Yes | No |

As previously explained, since the mat layer of the thermosensitive recording medium according to the present invention has a surface smoothness of 100 to 2000 sec before subjected to the thermal printing, and a portion of the mat layer subjected to the thermal printing has a surface smoothness of 5,000 sec or less at most, clear images can be formed on the thermosensitive recording medium by the thermal printing, and in addition, the air bubbles generating at the gap between the image bearing thermosensitive recording medium and the photo-setting resin plate can be easily removed therefrom in the course of the making of a form plate.

Japanese Patent Application No. 09-299587 filed Oct. 17, 1997, Japanese Patent Application No. 09-314647 filed Oct. 31, 1997, Japanese Patent Application No. 09-321971 filed Nov. 10, 1997, Japanese Patent Application No. 10-024050 filed Jan. 22, 1998, Japanese Patent Application No. 10-030398 filed Jan. 29, 1998, and Japanese Patent Application filed Oct. 16, 1998, are hereby incorporated by reference.

What is claimed is:

1. A thermosensitive recording medium capable of forming a visible image thereon for use as a block copy, comprising:

a transparent support, a thermosensitive recording layer provided on said transparent support, comprising a dye and a color developer capable of inducing a color in said dye upon the application of heat thereto in the course of thermal printing, and a transparent mat layer provided on said thermosensitive recording layer, comprising a granular filler and a binder resin comprising an ultraviolet curing resin in an amount of 50 wt. % or more of the entire weight of said binder resin, said mat layer having a surface smoothness of 100 to 2000 sec before being subjected to said thermal printing, and a portion of said mat layer subjected to said thermal printing having a surface smoothness of 5,000 sec of less at most.

2. The thermosensitive recording medium as claimed in claim 1, wherein said granular filler is partly protruded from the surface of said mat layer in a number of 1,000 to 5,000/mm$^2$.

3. The thermosensitive recording medium as claimed in claim 1, wherein said granular filler has an average particle diameter which is greater than an average thickness of said mat layer.

4. The thermosensitive recording medium as claimed in claim 1, wherein said granular filler comprises an organic filler.

5. The thermosensitive recording medium as claimed in claim 4, wherein said organic filler comprises spherical organic cross-linked filler particles with an average particle diameter of 3 to 10 $\mu$m.

6. The thermosensitive recording medium as claimed in claim 1, wherein said granular filler in said mat layer is in an amount of 5 to 10 wt. % of the entire weight of said mat layer.

7. The thermosensitive recording medium as claimed in claim 1, wherein said granular filler comprises giant filler particles with a particle diameter of [(d1+d2)×1.2] micrometer ($\mu$m) or more in an amount of less than 0.1 wt. % of the total weight of said granular filler, where said thermosensitive recording layer has a thickness of d1 micrometer ($\mu$m), and said mat layer has a thickness of d2 micrometer ($\mu$m).

8. The thermosensitive recording medium as claimed in claim 1, further comprising an intermediate layer interposed between said thermosensitive recording layer and said mat layer, comprising at least one resin selected from the group consisting of an ultraviolet curing resin and an electron-beam curing resin.

9. The thermosensitive recording medium as claimed in claim 1, wherein said color developer for use in said thermosensitive recording layer comprises an organic phosphoric acid compound of formula (1):

(1)

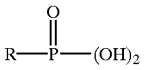

wherein R is a straight-chain alkyl group having 16 to 24 carbon atoms.

10. The thermosensitive recording medium as claimed in claim 1, wherein said color developer for use in said thermosensitive recording layer comprises an organic phosphoric acid compound of formula (2):

(2)

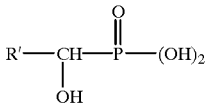

wherein R' is a straight-chain alkyl group having 13 to 23 carbon atoms.

11. A thermosensitive recording medium capable of forming a visible image thereon for use as a block copy, comprising:

a transparent support, a thermosensitive recording layer provided on said transparent support, comprising a dye and a color developer capable of inducing a color in said dye upon the application of heat thereto in the course of thermal printing, and a transparent mat layer provided on said thermosensitive recording layer, comprising a granular filler and a binder resin comprising an electron beam curing resin in an amount of 50 wt. % or more of the entire weight of said binder resin, said mat layer having a surface smoothness of 100 to 2000 sec before being subjected to said thermal printing, and a portion of said may layer subjected to said thermal printing having a surface smoothness of 5,000 sec or less at most.

12. The thermosensitive recording medium as claimed in claim 11, wherein said granular filler is partly protruded from the surface of said mat layer in a number of 1,000 to 5,000/mm$^2$.

13. The thermosensitive recording medium as claimed in claim 11, wherein said granular filler has an average particle diameter which is greater than an average thickness of said mat layer.

14. The thermosensitive recording medium as claimed in claim 11, wherein said granular filler comprises an organic filler.

15. The thermosensitive recording medium as claimed in claim 4, wherein said organic filler comprises spherical organic cross-linked filler particles with an average particle diameter of 3 to 10 $\mu$m.

16. The thermosensitive recording medium as claimed in claim 11, wherein said granular filler in said mat layer is in an amount of 5 to 10 wt. % of the entire weight of said mat layer.

17. The thermosensitive recording medium as claimed in claim 11, wherein said granular filler comprises giant filler particles with a particle diameter of {(d1+d2)×1.2} micrometer ($\mu$m) or more in an amount of less than 0.1 wt. % of the total weight of said granular filler, where said thermosensitive recording layer has a thickness of d1 micrometer ($\mu$m), and said mat layer has a thickness of d2 micrometer ($\mu$m).

18. The thermosensitive recording medium as claimed in claim 11, further comprising an intermediate layer interposed between said thermosensitive recording layer and said mat layer, comprising at least one resin selected from the group consisting of an ultraviolet curing resin and an electron-beam curing resin.

19. The thermosensitive recording medium as claimed in claim 11, wherein said color developer for use in said thermosensitive recording layer comprises an organic phosphoric acid compound of formula (1):

(1)
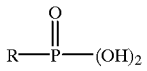
wherein R is a straight-chain alkyl group having 16 to 24 carbon atoms.
20. The thermosensitive recording medium as claimed in claim 11, wherein said color developer for use in said thermosensitive recording layer comprises an organic phosphoric acid compound of formula (2):
(2)
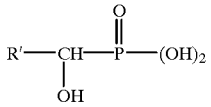
wherein R' is a straight-chain alkyl group having 13 to 23 carbon atoms.
* * * * *